United States Patent [19]

Vuilleumier

[11] 3,972,177

[45] Aug. 3, 1976

[54] CONTROL MECHANISM FOR TIME SETTING AND SIMILAR FUNCTIONS

[75] Inventor: Cyril Vuilleumier, Bienne, Switzerland

[73] Assignee: Societe Suisse pour l'Industrie Horlogere Management Servies S.A.

[22] Filed: Apr. 2, 1975

[21] Appl. No.: 564,467

[30] Foreign Application Priority Data

Apr. 8, 1974 Switzerland ..... 4908/74

[52] U.S. Cl. ..... 58/63; 58/85.5

[51] Int. Cl.[2] ..... G04B 27/02

[58] Field of Search ..... 58/63, 64, 73, 85.5, 58/88 B

[56] References Cited

UNITED STATES PATENTS

| | | | |
|---|---|---|---|
| 3,487,631 | 1/1970 | Morita | 58/63 X |
| 3,576,100 | 4/1971 | Vogt | 58/63 X |
| 3,673,790 | 7/1972 | Gasser et al. | 58/63 X |
| 3,756,015 | 9/1973 | Saito et al. | 58/63 X |
| 3,762,153 | 10/1973 | Komiyama et al. | 58/63 X |
| 3,762,156 | 10/1973 | Vuileumier | 58/63 |
| 3,765,164 | 10/1973 | Esselborn | 58/63 |
| 3,849,977 | 11/1974 | Hirose et al. | 58/85.5 X |
| 3,866,407 | 2/1975 | Wuthrich | 58/63 X |
| 3,866,408 | 2/1975 | Gerber | 58/63 |

*Primary Examiner*—Stanley J. Witkowski

*Attorney, Agent, or Firm*—Griffin, Branigan and Butler

[57] ABSTRACT

A control mechanism for setting a watch or the like includes a rotatable trigger piece, a stem actuatable from the exterior of the timepiece, linkage between the stem and the trigger piece, and a setting lever which cooperates with the trigger piece for moving setting linkage into a proper position upon actuation of the stem. The resilient setting lever is biased from its pivot through its resilient length to urge its opposite end against the trigger piece and thereby hold the trigger piece in set positions. The resilient setting lever is part of a V-shaped resilient element which straddles the trigger piece.

8 Claims, 4 Drawing Figures

CONTROL MECHANISM FOR TIME SETTING AND SIMILAR FUNCTIONS

This invention concerns a timekeeping instrument and in particular relates to a mechanism controlled by a stem accessible from the timepiece exterior and which may provide a number of different control functions as for example time setting.

Arrangements of this nature are well known and in general they serve to wind a watch main spring and set time. Such mechanisms are formed of a number of highly specialized small mechanical elements which co-operate among themselves according to the manipulation of the stem as controlled from a crown arranged at the exterior of the timepiece.

The considerable number of parts forming these mechanisms (trigger piece, jumper spring, lever, lever spring, trigger piece support spring) results in a considerable degree of complexity and thus such mechanisms are relatively delicate and costly. Should further functions be required of these mechanisms this complexity increases further, particularly should one wish to remove the control stem without too much difficulty.

The object of the present invention is to provide a mechanism to reduce these difficulties through considerable simplification and while being reliable in its function to provide several operations and at the same time enable removal and reintroduction in a particularly simple fashion of the control stem without necessiting a special form thereof such as a jointed stem.

The invention therefore teaches a mechanism comprising a trigger piece actuated by a stem and in which a single element provides the mechanical functions of a spring or bridge jumper for the trigger piece, of a lever spring and of a trigger piece retainer spring. This element which is in the form of a "V" is fastened adjacent its point in a manner such that the arms are parallel to a support, its arms being formed by flexible blades one of which is terminated by an expanded portion which assumes the function of the lever and co-operates with a first beak on the trigger piece.

The other blade which is supported on the upper face of the trigger piece and on the side surface of the axis of rotation of the trigger piece has at its extremity a stud arranged to co-operate with a second beak formed on the trigger piece. This latter beak serves to urge the second blade apart from the first and to slide over a protuberance thereby being lifted up and permitting separation of the stem from the trigger piece. This second beak of the trigger piece in another position may actuate an electrical contact. Preferably, the first blade of the "V" element which acts as lever carries a setting wheel which remains permanently in engagement with a sliding pinion carried by the stem.

Figure 1:
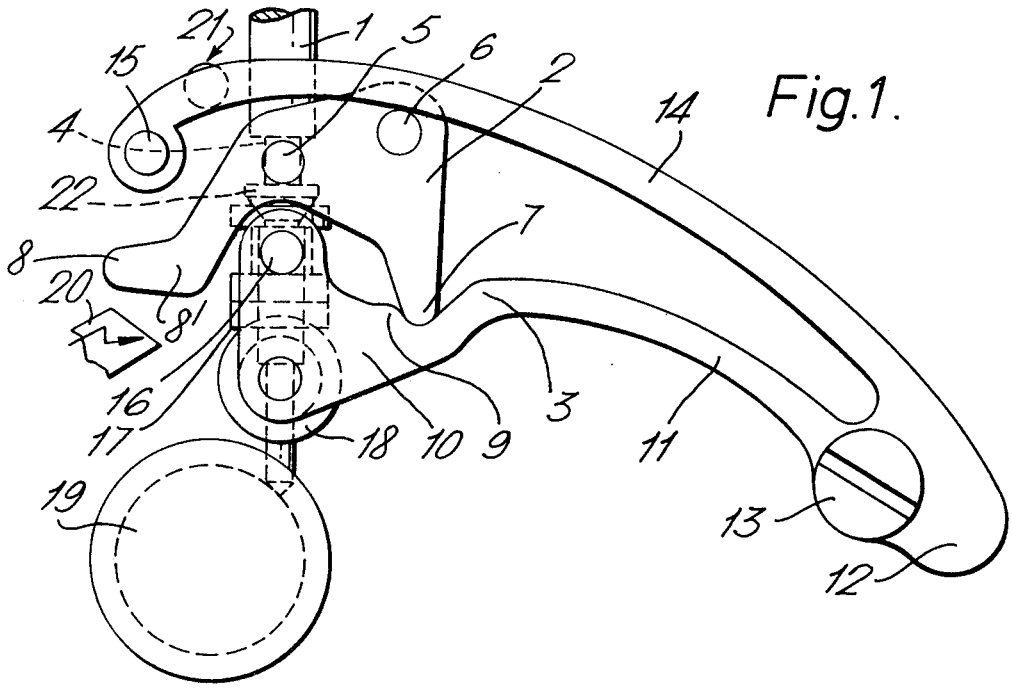
Figure 2:
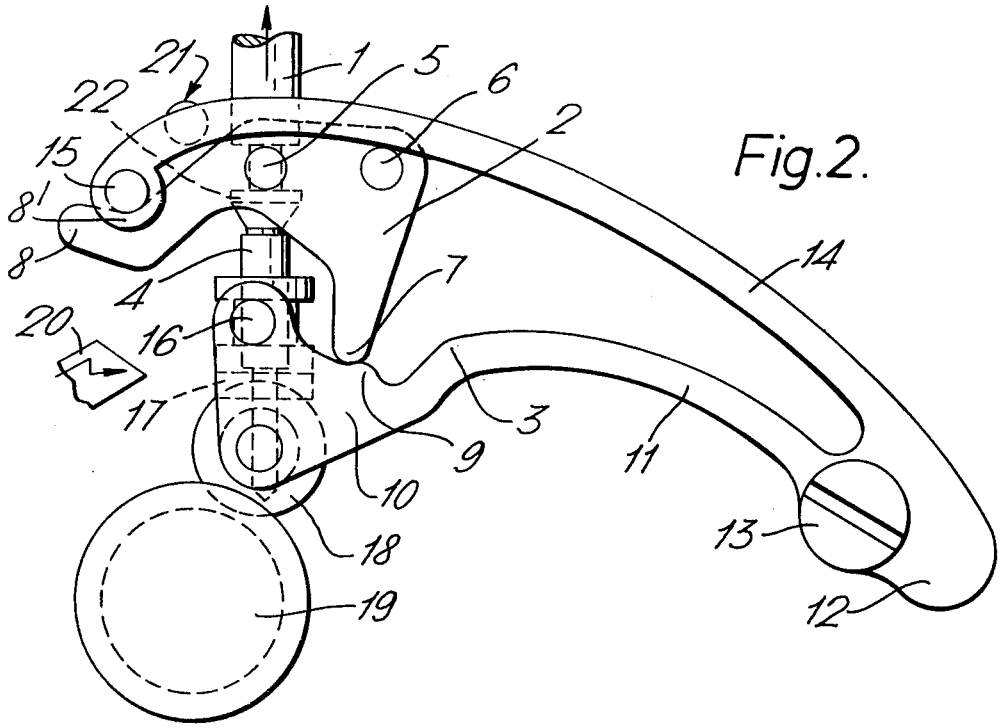
Figure 3:
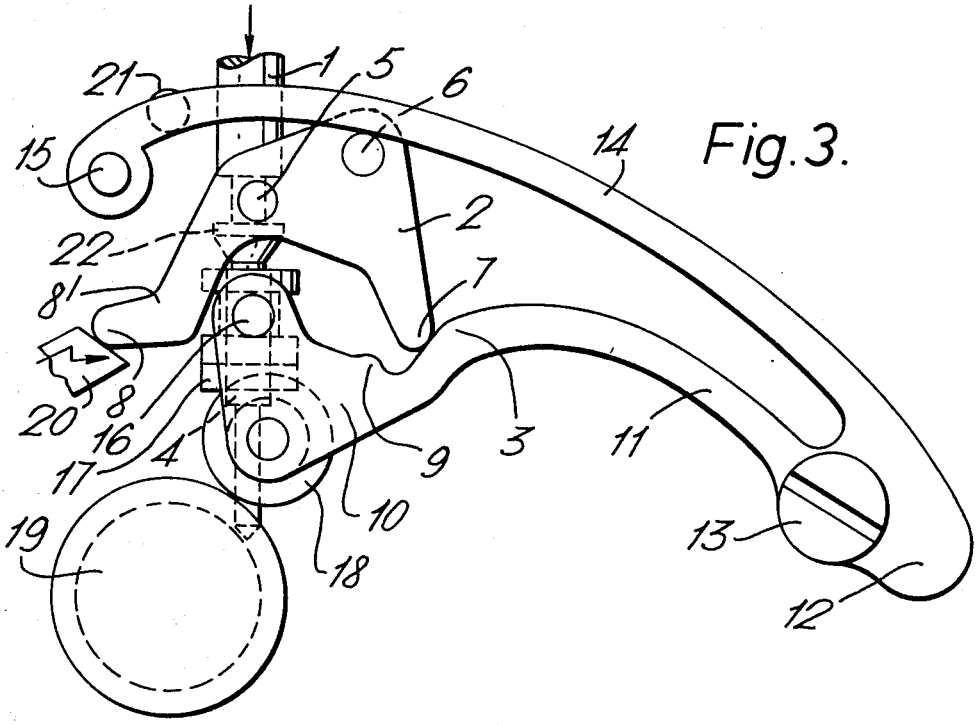
Figure 4:
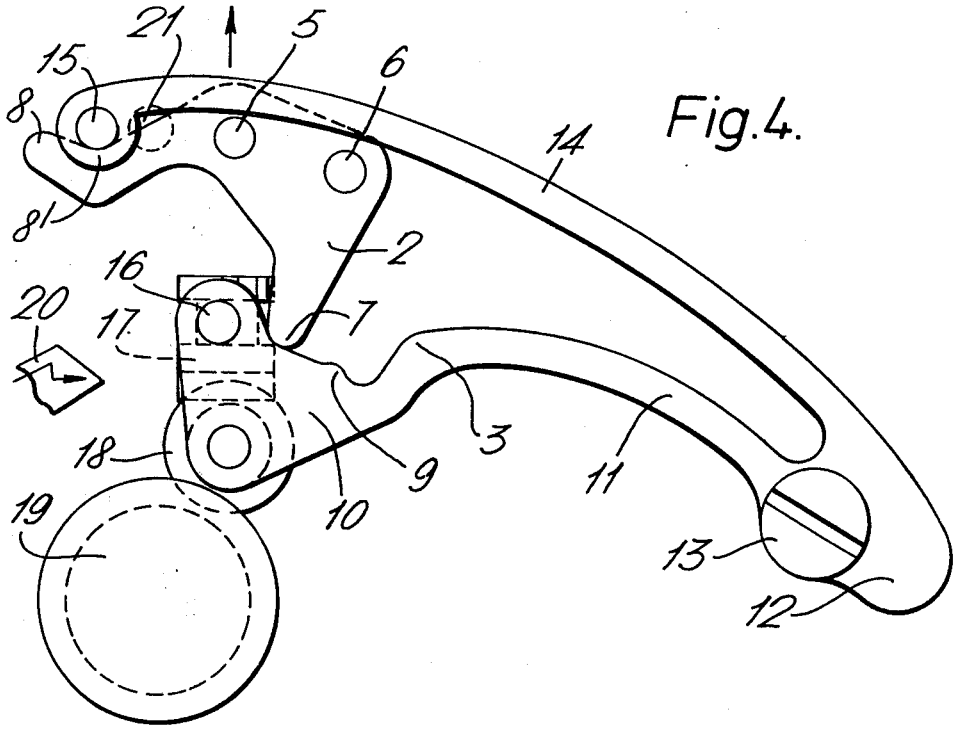

To promote understanding of the invention reference will now be made to the attached drawings in which FIG. 1 shows the mechanism in rest position FIG. 2 shows the elements of the mechanism in the position for time setting FIG. 3 shows the position of the elements opposite to that of the setting position FIG. 4 shows the mechanism following removal of the stem.

In the form of the invention as shown by way of example and not intended to be limiting, the mechanism is intended for use in an electronic timepiece provided with a high frequency time standard, a frequency dividing circuit and a time display by time indicating hands driven by a motor. It may occupy two functioning positions on either side of a neutral position. In one of these positions it permits correction of the hour hand by steps equal to an integral number of hours without affecting the rotational movement of the minute or seconds hands. In the other functional position it actuates an electrical contact thereby to cut out a certain number of stages of the frequency divider so as to increase the rotation speed of the motor thereby to enable a rapid resetting of the minute and seconds hands.

As shown in the figures the mechanism is essentially comprised of a stem 1, a trigger piece 2 and an element 3 having multiple functions among which are those of a lever and being generally in the form of a "V". Stem 1 is provided in the usual fashion with a circular groove 4 arranged to accommodate a stud 5 fixed to the trigger piece. Trigger piece 2 is a flat element which may rotate about a fixed axis 6. It is provided with two beaks 7 and 8 located respectively on either side of stem 1 when the latter is in place.

The first beak 7 of trigger piece 2 is in permanent contact with the edge of an area 9 of a planar portion 10 of element 3. This portion 10 forms the approximate mechanical equivalent of the usual lever wherein movements of beak 7 determine at all times its functional position. Its form as shown in the direction going away from the stem is continued by a flexible blade 11 which forms a branch of the "V" and is terminated by an expanded portion 12 comprising the point of the "V". Adjacent the expansion 12 the second flexible blade 14 is formed as an integral portion of element 3 which is developed in the direction of axis 6 passing there behind and in contact therewith. It is supported on the upper face of trigger piece 2 and thus performs the function of trigger piece retainer spring spring. It is terminated beyond stem 1 by a small expansion carrying on its lower surface a cylindrical stud 15.

Element 3 is fastened at the expansion 12 to a support member by means of a screw 13 preferably in a manner enabling small rotational movements.

Portion 10 of element 3 carries on its lower face a stud 16 which determines the axial position of the sliding pinion 17 on stem 1. Portion 10 likewise is provided with a toothed setting wheel 18 which remains permanently in engagement with sliding pinion 17. The planar displacements of portion 10, of sliding pinion 17 and setting wheel 18 responsive to a movement of the first beak 7 of trigger piece 2 are thus carried out simultaneously and without relative movement among these elements.

The area 9 of portion 10 of element 3 is profiled so that its effect on first beak 7 of trigger piece 2 in conjunction with that of flexible blade 11 insures that trigger piece 2 will be locked in position when the entire mechanism is in rest position as shown in FIG. 1 or the time setting position as shown in FIG. 2. In this respect it is to be noted that flexible blade 11 has a constant bias applied from its pivot along its resilient length such as to urge portion 10 in the direction of axis 6. Blade 11 alone thus functions as lever spring and in respect of area 9 thereof and of blade 14 which is supported on the trigger piece 2 it performs the function of bridge jumper for the trigger piece.

In order to correct the hour hand indication the mechanism will be as shown in FIG. 2 and the elements are brought into this position by drawing stem 1 towards the exterior until the first beak 7 of trigger piece 2 takes up a stable position on the edge of area 9. Portion 10 of element 3 is urged against the bias of flexible blade 11 and during its displacement shifts sliding pinion 17 and setting wheel 18. The longitudinal movement of sliding pinion 17 on stem 1 is stopped when a concave profile forming a portion of the second beak 8 of trigger piece 2 engages stud 15 with a certain elasticity in view of blade 14. The setting wheel is thus positioned so as to transmit a rotational correcting movement to wheel 19 coupled to the hour hand, such movement being controlled through rotation of the stem by means of a crown. The transmission elements from the movement to the hour hand may comprise a magnetic clutch such as has been described in Swiss Pat. No. 566,042 published Mar. 27, 1975, and which permits the hour hand to perform precise steps of one or several 12ths of a revolution without in any way interfering with the normal function of the remainder of the watch movement.

A further function of the mechanism is obtained when the stem is pushed inwardly from its neutral position in the example as shown in FIG. 3. This may take the form of bringing about a rapid advance in the seconds and minute hands. The first beak 7 of the trigger piece 2 slides along the edge of flexible blade 11, against the bias thereof and is displaced away from area 9. At the same time the second beak 8 engages an electric contact 20 which may be arranged to increase the frequency of motor controlled signals by cutting out a predetermined number of divider stages. The spring effect resulting from blades 11 and 14 returns the mechanism to its neutral position as soon as the user releases the crown on stem 1 once the minute and seconds setting has been completed.

Should the user pull out the stem in increasing considerably the tension beyond the position at which the hour hand is corrected the contact pressure of the region 8' of the second beak 8 on the stud 15 is likewise increased to the point where counterpressure owing to the spring bias of blade 14 is overcome. As shown in FIG. 4 the blade is forced outwardly and is followed in its motion by the trigger piece of which the lower surface slides along the lateral surface of a fixed conical stud 21. The trigger piece is thereby raised to a height greater than the length of stud 5 which latter is disengaged from circular slot 4 whereby stem 1 may be easily removed if the user continues to pull thereon.

Stem 1 may be reinserted without difficulty, it sufficing to push it to the bottom. The truncated conical portion 22 integral therewith will lift up stud 5 which will subsequently fall into place in the circular slot of stem 1.

What we claim is:

1. A timepiece comprising a stem control mechanism capable of assuming at least two operative positions on either side of a neutral position, thereby to effect time setting, said control mechanism including:

a rotatable trigger piece, said trigger piece forming at least one protruding beak;

a stem actuatable from the exterior of the timepiece to be moved axially between said neutral and said at least two operative positions;

a linking means for mechanically linking said stem and said trigger piece to thereby rotate said trigger piece when said stem is moved axially;

a setting wheel mechanism linked to said stem for setting the time indication of said time piece when said setting wheel is in an operative position in response to rotation of said stem; and a resilient elongated setting lever having a pivot at a first end thereof and being mechanically linkable to said setting wheel mechanism at an opposite end thereof, said setting lever being biased from its pivot along its resilient length to urge said opposite end against said at least one protruding beak of said trigger piece for moving said setting wheel to said operative position in response to rotation of said trigger piece, said elongated setting lever having a contour for meshing with said at least one beak to hold said trigger piece in stable positions.

2. Control mechanism according to claim 1 wherein the setting lever is a portion of an element in the general form of a "V" and is fixed preferably in a fashion permitting rotation at the point of the "V" or in immediate proximity thereto.

3. Control mechanism according to claim 2 wherein the arms of the "V" are formed by flexible blades of which the first blade is the setting lever and cooperates with a first beak on the trigger piece, said first beak determining the functional position of the setting lever.

4. Control mechanism as in claim 3 wherein the second arm of the "V" is supported on the upper surface of the trigger piece and on said lateral axis of the trigger piece, the axis being located between the arms of the "V".

5. Control mechanism as in claim 4 wherein the outer extremity of the second arm of the "V" comprises a stud means to contact a second beak on the trigger piece in order to limit the displacement of said trigger piece thereby determining the first functional position of the mechanism.

6. Control mechanism as in claim 5 wherein the application of a force between the stud and the second beak of the trigger piece above a predetermined limit forces the second arm of the "V" towards the exterior whereby the lower surface of the trigger piece is upwardly urged along the cam surface of a fixed stud thereby permitting disengagement of the stem.

7. Control mechanism as in claim 6 wherein the second beak of the trigger piece when urged into a second functional position opposed to the first functional position relative to an intermediate neutral position is arranged and adapted to establish or break an electrical contact.

8. Control mechanism as in claim 2 wherein is further included a sliding pinion mounted on the stem and wherein the setting lever controls the position of the sliding pinion and further includes a setting wheel which is permanently engaged with the sliding pinion.

* * * * *